US008229671B2

(12) United States Patent
Pritchard et al.

(10) Patent No.: US 8,229,671 B2
(45) Date of Patent: Jul. 24, 2012

(54) METHOD AND SYSTEM FOR RISERLESS CASING SEAT OPTIMIZATION

(76) Inventors: David M. Pritchard, Spring Branch, TX (US); Kenneth J. Kotow, Sugar Land, TX (US)

( * ) Notice: Subject to any disclaimer, the term of this patent is extended or adjusted under 35 U.S.C. 154(b) by 482 days.

(21) Appl. No.: 12/635,511

(22) Filed: Dec. 10, 2009

(65) Prior Publication Data

US 2011/0036587 A1 Feb. 17, 2011

Related U.S. Application Data

(60) Provisional application No. 61/233,765, filed on Aug. 13, 2009, provisional application No. 61/243,079, filed on Sep. 16, 2009.

(51) Int. Cl.
*G01V 1/40* (2006.01)

(52) U.S. Cl. ..... 702/6

(58) Field of Classification Search ..... 702/6, 13, 702/14, 182–185, 188
See application file for complete search history.

(56) References Cited

U.S. PATENT DOCUMENTS

| | | | | |
|---|---|---|---|---|
| 3,399,723 | A | 9/1968 | Stuart | |
| 6,138,774 | A | 10/2000 | Bourgoyne, Jr. et al. | |
| 6,712,153 | B2 | 3/2004 | Turley et al. | |
| 7,124,831 | B2 | 10/2006 | Turley et al. | |
| 7,150,324 | B2 | 12/2006 | Laursen et al. | |
| 7,172,037 | B2 | 2/2007 | Dashevskiy et al. | |
| 7,630,914 | B2 * | 12/2009 | Veeningen et al. | 705/7.28 |
| 2004/0149431 | A1 * | 8/2004 | Wylie et al. | 166/242.1 |
| 2004/0236513 | A1 | 11/2004 | Tutuncu et al. | |
| 2005/0209836 | A1 | 9/2005 | Klumpen et al. | |
| 2008/0052003 | A1 | 2/2008 | Moos et al. | |

(Continued)

OTHER PUBLICATIONS

"International Search Report," International Application No. PCT/US10/45341, (5 pages), Date of mailing Nov. 15, 2010.

(Continued)

*Primary Examiner* — Edward Raymond
(74) *Attorney, Agent, or Firm* — Stetina Brunda Garred & Brucker

(57) ABSTRACT

A system and method for optimal placement of a riserless casing in a subsea drilling environment having the steps of: receiving input of pore pressure data for a well site; receiving input of fracture gradient for said well site; receiving input of the anticipated true vertical depth of said well site; integrating pore pressure data, fracture gradient data with said true vertical depth values; computing a pore pressure and fracture gradient verses true vertical depth graph; determining the true vertical depth at which the pore pressure begins to exceed the normal gradient of salt water; and determining the placement of a conductor casing string by corresponding the gradient true vertical depth to the true vertical depth of where the pore pressure beings to exceed the normal gradient of salt water. The method improves upon conventional placement of the riserless casing by optimizing the placement to achieve larger diameters in the wellbore, increased well depth, and mitigation of shallow hazards. Furthermore, the method of the present invention transforms readily available data to calculate optimal placement of a structural casing string to serve a dual purpose by providing not only structural integrity for the wellbore, but also ensuring leak-off integrity by taking advantage of the early growth of the fracture gradient of the natural subsea environment. Also, the suggestion that casing drilling will assist in mitigating shallow drilling hazards to allow casing seats to be placed as prescribed by this present invention. The method of the present invention may be implemented by a computer based apparatus or implemented using executable computer code on a computer based system.

37 Claims, 13 Drawing Sheets

U.S. PATENT DOCUMENTS

2008/0110673 A1 5/2008 Giroux et al.

OTHER PUBLICATIONS

"PCT Written Opinion of the International Searching Authority," International Application No. PCT/US10/45341, (4 pages), Date of completion of Opinion Oct. 13, 2010, Date of mailing Nov. 15, 2010.

Gill et al., Deepwater Cementing best Practices for the Riserless Section, AADE-05-NTCE-70 [Paper], Apr. 7, 2005 [retrieved on Oct. 13, 2010]. Retrieved from the Internet: URL: http://www.aade.org/TechPapers/2005Papers/Web/Cementing__Annular__Pressure__control/AADE-05-NTCE-70%20%-%20Gill.pdf> Abstract; pg. 2, para [0001], (28 pages).

Pritchard, David and Kotow, Kenneth, "Riserless drilling with casing: GOM well design model requires change for deepwater drilling", Drilling Contractor, Jul./Aug. 2009, pp. 42, 44 and 45.

Unknown, "Wellbore Construction: Module 3", BP/Chevron Drilling Training Alliance, Course Matter, www.drlg.com, Houston, TX, date unknown, 48 pages.

* cited by examiner

METHOD AND SYSTEM FOR RISERLESS CASING SEAT OPTIMIZATION

CROSS-REFERENCE TO RELATED APPLICATIONS

This application claims the benefits of provisional patent application Ser. No. 61/233,765 filed on Aug. 13, 2009, the entire contents of which is incorporated herein by reference. This application also claims the benefits of provisional patent application Ser. No. 61/243,079 filed on Sep. 16, 2009, the entire contents of which is incorporated herein by reference.

STATEMENT RE: FEDERALLY SPONSORED RESEARCH/DEVELOPMENT

Not Applicable

BACKGROUND

The present invention relates generally to a system and method for optimizing riserless drilling casing seats used in offshore deepwater drilling from a floating platform. More particularly, the present invention uses a system and method for determining the optimal placement of the initial casing seats by using, among other criteria, the relationship between the pore pressures and fracture pressures to determine a depth that will optimize placement of riserless casing seats to achieve deeper well depths, minimize casing diameter reduction, decrease the likelihood of well failure and more efficient use of well construction materials.

The continuing demand for crude oil and natural gas combined with the limited number of near shore fields and has provoked the exploration and production of offshore crude oil and natural gas to increasing water depths. Increasing water depths have required the use of floating platforms that support a drilling rig and drilling equipment. Advances in floating platform technology has increased the weight loads that the platforms can safely utilize and as such, drilling strings, generally formed of jointed steel pipe, can reach greater depths.

In conventional floating platform deepwater drilling, riserless drilling is used. In riserless drilling there is no return conduit provided back to the platform surface, as is done in many shallow water drilling operations. In conventional riserless drilling, the drilling cuttings and other by-products are discharged to the seafloor and are typically swept away by currents. In drilling the riserless portion of the well, the first casing, typically of a length of about 250 to 350 feet, is lowered from the platform and jetted into place into the seafloor. This first string of casing is commonly referred to as the structural or conductor string. A general description of riserless drilling is provided in U.S. Pat. No. 7,150,324, the entire substance of which is incorporated herein by reference.

The current approach of "jetting" in the first string of casing, usually 250 to 350 ft below the mud line, results in a casing seat being placed too shallow thereby not providing enough leak-off tolerance for the drilling of the next hole section. This is due to the very soft formations which have little strength or competency for fracture resistance and leak-off. The current philosophy of the first casing seat placement is to provide structural support for the weight of the subsequent casing strings and the bending moment of the riser, which will be eventually attached. The general intended purpose of the structural string is limited to supporting the weight of subsequent casing strings and wellhead, and the resistance of bending moment of the riser loading. Despite this perception, in reality, the structural string's ability to support much of an axial load is limited and thus can become a structural failure hazard if there is not enough soil bearing strength for the landing of the subsequent strength of casing and wellhead. The conventional approach adds little to the value of the well design, since this casing setting depth does not supply sufficient axial loading resistance for structural support of subsequent deeper casing strings nor does it supply sufficient bending load or sufficient rising bending moment. Also, there is no value related to the growth of the fracture gradient in the first string and that negatively impacts the overall well design by wasting casing diameters. Because the conventional placement of the casing well above every anticipated drilling hazard, such placement negatively impacts the casing diameters and hole sizes for well depths that routinely exceed 30,000 ft in measured depth. In this regard, the structural casing placement has been conventionally completed without regard to its optimal placement depth, but rather as a mere first step in the process of riserless drilling.

As is understood in the art, deepwater oil drilling is an expensive and time intensive venture. Daily operating costs often approach $1,000,000.00 requiring 100 days or more to drill before achieving the well objectives. Therefore, it is critical to deepwater field development to reduce well costs and to improve the attainment of these well objectives. The complex deepwater drilling environments have pushed well design to its limits and while many of the aspects of deepwater drilling and well design are being optimized, the optimal placement of the first and subsequent casing seats have been overlooked. As such there is a need in the art for a system and method that takes advantage of the increased maximum loads from floating platforms and provides for the determination of the optimal depth of placement of the early depth casing seats and placement of those seats to maximize drilling depths, drilling time and costs of operation.

BRIEF SUMMARY

The present invention provides a system and method of optimizing casing seats for riserless deepwater oil and natural gas drilling of hole sections and corresponding stings of casings by providing a design system and methodology for optimum casing set placement. The well design system and method of the present invention effectively takes advantage of the shallow and rapid growth of the fracture gradient in the subsea environment to optimize casing seats and shallow hazard mitigation and therefore improves leak-off tolerances for each successive casing string which allows for fewer and larger diameter casing strings than in a conventional deepwater well. In operation, the method and system of the present invention employs the use of common oilfield tubular diameters to attain well true vertical depth, allows for more conventional hole diameters for mechanical and geological sidetracks, a final well diameter that is optimized for field development flow rates, limiting failure hazards, allowing for the attainment of well objectives and well field development economic objectives.

The system and method of optimizing casing seats for riserless deepwater drilling of the present invention applies to the riserless drilled sections of deepwater drilling environments, primarily above salt formations (supra salt) but can also apply to any deepwater riserless environment requiring improvements in casing seat placement, whether salt is present or not. In operation, the casing seat placements are calculated and determined to meet pore pressure and fracture gradient leak-off requirements, also providing an acceptable leak-off for all subsequent casing string drilling operations, as well as meeting structural requirements beginning with the first casing string. In order to successfully determine and design such a composite or telescoping string of casings for minimizing the number of casing strings and diameters of casing strings for the improved well design, the first casing string must provide for, and take advantage of, the natural progressive growth of the fracture gradient. Therefore, the design of the first string provides both structural integrity as well as leak-off integrity for the drilling and subsequent placing of the subsequent casing strings. One of the differences of the present invention as compared to the prior art conventional riserless casing string placement is that data is used to calculate the optimal placement of the first casing string, normally referred to as the "structural" string. The structural string, with implementation of the present invention, becomes a dual purpose casing string: the string is not only structural, but also provides leak off tolerance by way of honoring the early growth of the natural fracture gradient of the subsea environment. The suggestion that casing drilling will assist in mitigating shallow drilling hazards to allow casing seats to be placed as prescribed by this present invention.

BRIEF DESCRIPTION OF THE DRAWINGS

These and other features and advantages of the various embodiments disclosed herein will be better understood with respect to the following description and drawings, in which like numbers refer to like parts throughout, wherein.

DETAILED DESCRIPTION

The description herein is given by way of example, and not limitation. Given the disclosure herein, one skilled in the art could devise variations that are within the scope and spirit of the invention disclosed herein, including various ways of calculating optimal depth data or casing seat placement. Further, the various features of the embodiments disclosed herein can be used alone, or in varying combinations with each other and are not intended to be limited to the specific combination described herein. Thus, the scope of the claims is not to be limited by the illustrated embodiments.

The present invention relates to a system and method for the optimum placement of drilling casing strings in deepwater drilling environments. The present invention uses a computer for processing and calculating the data necessary to optimize the placement of the casing strings as described herein. In operation, the code used to execute the data collection and computation may be preferably placed on a computer server which is accessible by one or more peripheral devices. The server may include one or more computer memories for storing accumulated data, and one or more processers for completing the calculations necessary to perform the steps of the method of the present invention. Furthermore, the computer code of the method of the invention may be stored on a storage medium readable by a computer, wherein the storage medium tangibly embodies one or more of the computer programs set of instructions executable by the computer to perform the method of optimal placement of the support casing in a subsea drilling environment. The method of the present invention may also include the actual production of the executable computer program code, and providing the code program to be deployed and executed on the computer system to thereafter complete the method for determining the optimal placement of the casing strings as described herein.

Figure 2:
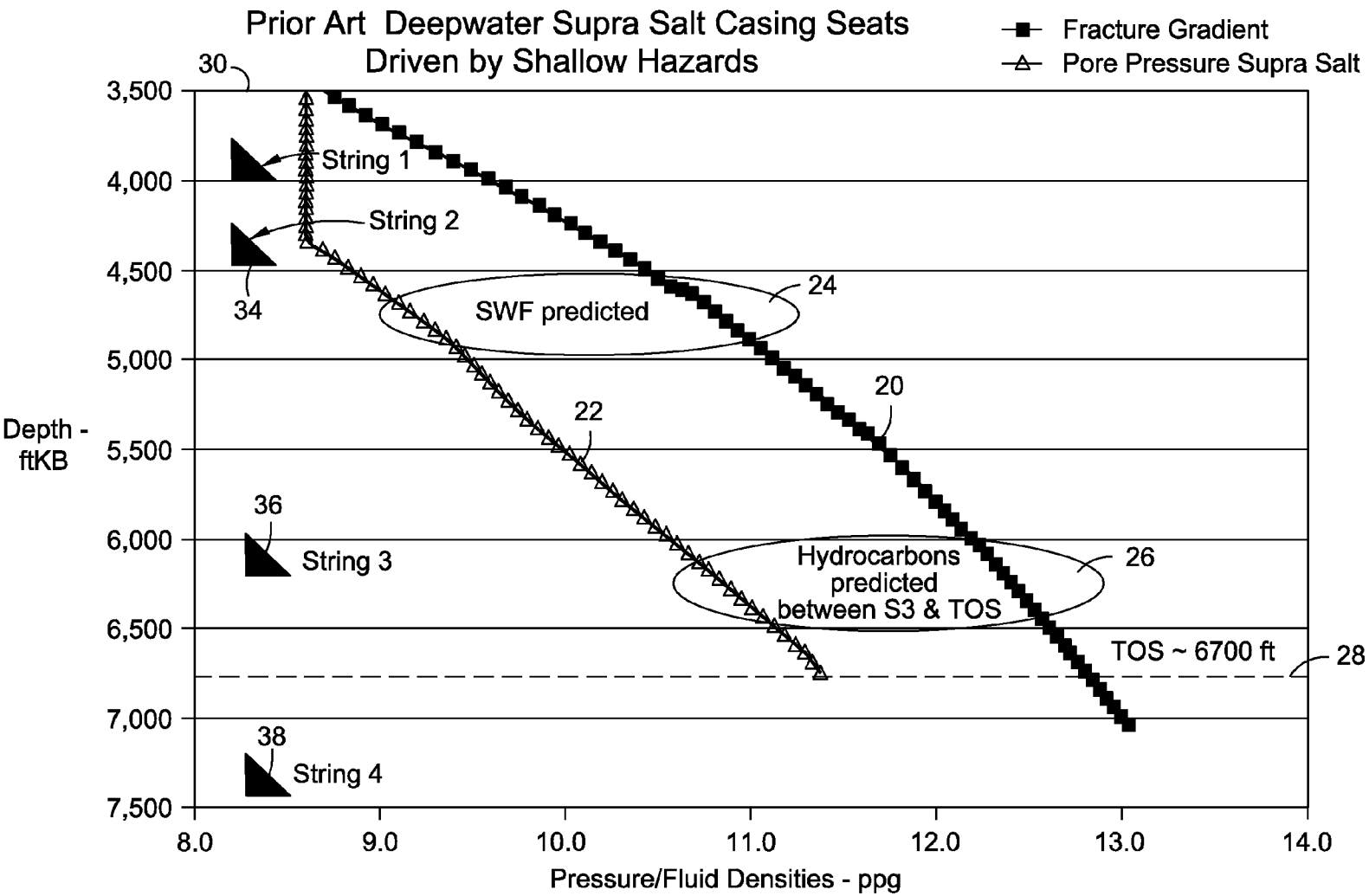
FIG. 2 (PRIOR ART)
FIG. 2 graphically illustrates the fracture gradient and pore pressure of a prior art deepwater supra salt casing seat well design and the non-optimized placement of the casing strings.
Figure 3:
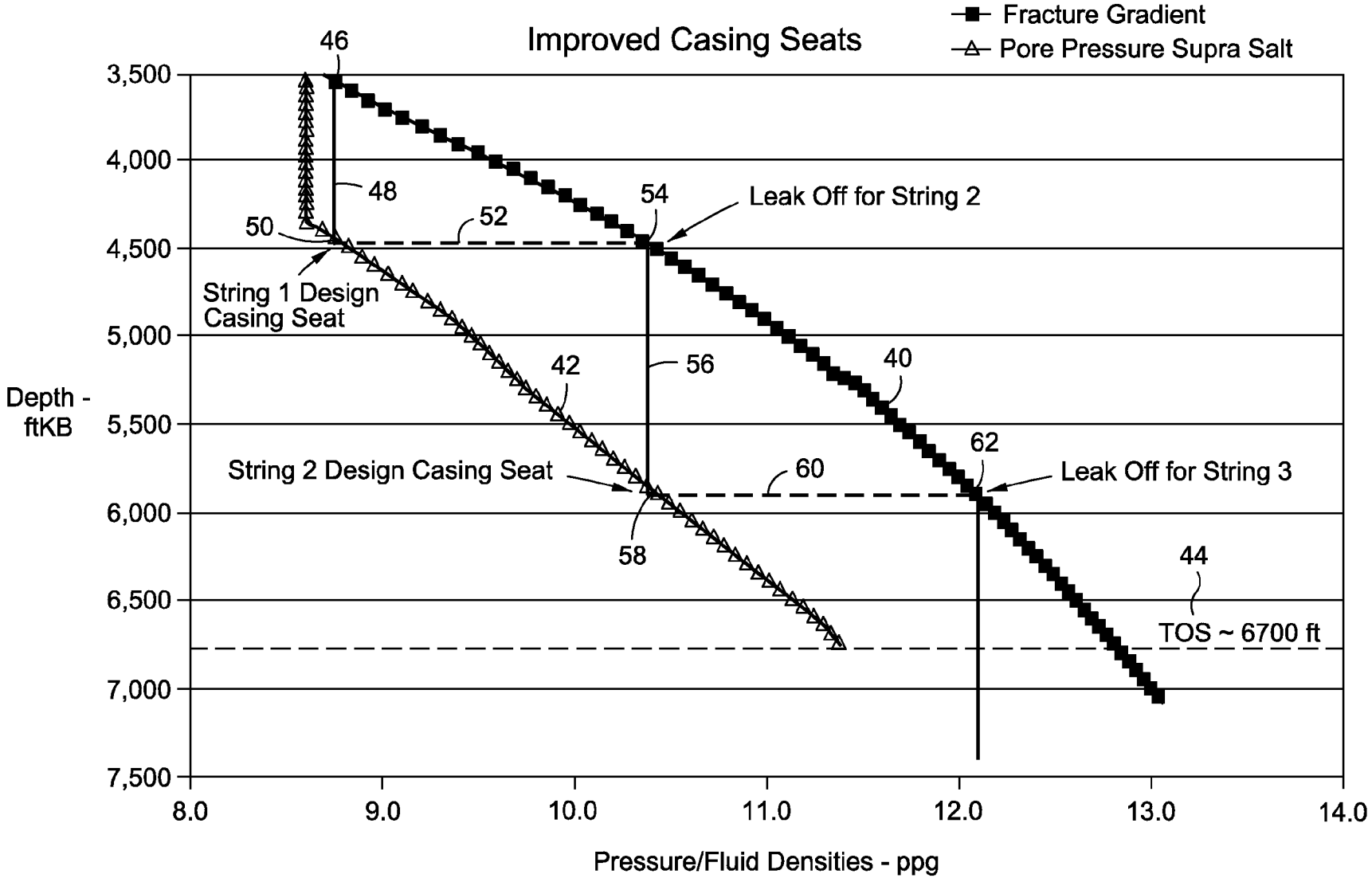
FIG. 3 graphically illustrates the fracture gradient and pore pressure of the improved casing seat of the present invention, and the optimal positioning of the casing seats.
Figure 4:
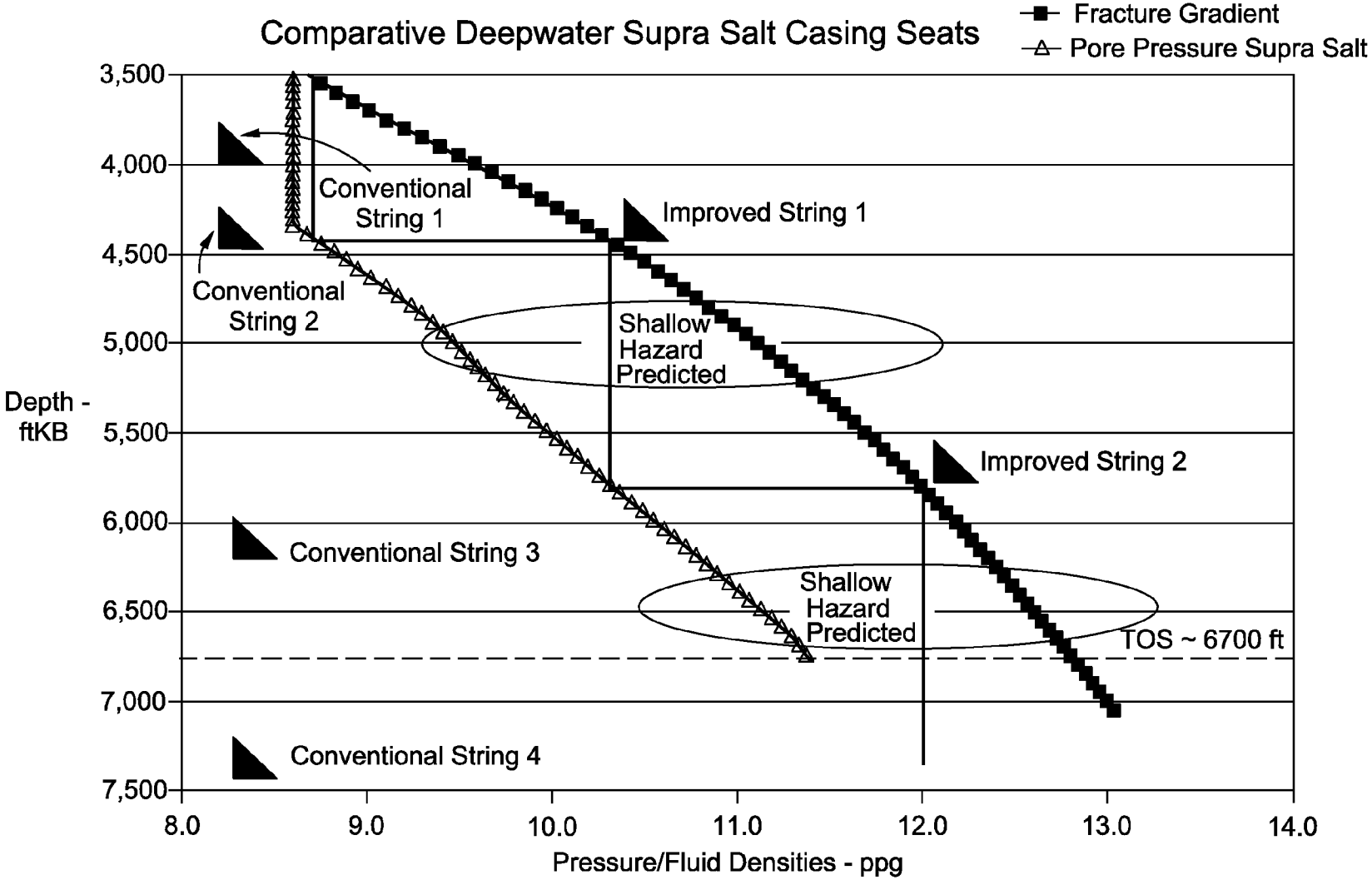
FIG. 4 graphically illustrates the fracture gradient and pore pressure of both the prior art conventional string placement and the placement of the present invention (a combination of FIG. 2 and FIG. 3).

Referring particularly to FIGS. 2, 3, and 4 the method and system of the present invention improves upon the conventional approach of "jetting" the first string of casing into the subsea surface usually 250 to 350 feet below the mud line. In the prior art, because the casing seat is placed in an undesirable shallow position, such placement does not supply enough "leak-off" tolerance for the drilling in the next hole section due to typically soft formations encountered at shallow depths where there is little strength or competency for facture resistance. "Leak-off" is typically understood as the amount of pressure, expressed in pound per square inch (or similar units such as metrics) per true vertical foot of well depth (psi/foot) that is exerted by a column of drilling fluid on the formation being drilled where that fluid will continue to enter the formation or "leak-off". The leak-off pressure is the maximum pressure of equivalent circulating mud density that may be applied to the well during the drilling operation. The "equivalent circulating density" is generally understood as the effective mud density expressed in pounds per square inch (or similar units such as metrics) per true vertical foot of well depth (psi/foot) exhibited by a circulating fluid at a circulating rate in gallons per minute (or similar units such as metrics) against the formation that takes into account the pressure drop in the annulus above the point of circulation due to friction and hydrostatic pressure.

In the prior art placement of casing strings, the first casing string, which may be commonly referred to as the structural or conductor string is typically designed for the limited purpose of supporting the weight of the subsequent casing strings and well head and the resistance of bending moment of the riser loading. In practice, however, the conductor string in the prior art may have limited ability to support such an axial load and can thus become a structural failure hazard if there is not enough soil bearing strength for the landing of the subsequent strength of casing and well head. As such, there is no value related to the growth of the fracture gradient in the first casing "structural" string in current well designs and this negatively impacts the overall well design by "wasting" casing diameters. For example, as graphically demonstrated in FIG. 4A, casing strings are placed in the well with each section of casing telescoping from the first large diameter conductor string to smaller diameter casing strings as the depth increases. In this regard, by placing the first casing string at a shallow depth, a diameter is wasted as the next placement is close to the mud line, but of lesser diameter. Therefore, in the prior art as graphically demonstrated in FIG. 2 such additional casing strings above each anticipated drilling hazard further negatively impact the casing diameters and hole sizes available for well depth that routinely exceed 30,000 feet measured depth.

Referring particularly to FIG. 2, there is graphical depiction showing the prior art deepwater supra salt casing seats. The fracture gradient and pore pressure supra salt are plotted graphically in FIG. 2. The facture gradient is the amount of pressure, expressed in pound per square inch (or similar units such as metrics) per true vertical foot of well depth (psi/foot) that is required to induce fractures in a rock at a given true vertical depth. The pore pressure is the amount of pressure or stress expressed in pounds per square inch (or similar units such as metrics) for true vertical foot of well depth (psi/foot) transmitted through the interstitial fluid of a soil or rock mass. Fracture gradient curve 20 is shown along with the pore pressure curve 22. Riserless drilling methodology uses a mixture of seawater and drilling mud with the primary drilling fluid pumped down through a drill pipe. The drilling fluid cleans and cools the drill bit and lifts cuttings out of the hole as the hole is being drilled. Since there is not a riser conduit to the drilling rig, there are no drill cuttings to return to the rig, but rather the cuttings in the drilling fluid are returned directly to the seafloor where they may be dissolved or otherwise swept away by sea current.

FIG. 2 represents the prior art of placement strings in riserless drilling with facture gradient curve 20 and pore pressure curve 22 charted is a specific example of what may be encountered with a particular example well design and associated geological conditions. In particular, the representation of FIG. 2 is exemplary, and fracture gradient curve 20 and the pore pressure 22 curve may change with different well designs, locations, different depths or geological conditions. Furthermore, in specific situations, shallow water hazards 24 may be predicted for a particular well location. Furthermore, hydrocarbon features 26 may also be predicted. In the particular example of FIG. 2, the top of salt ("TOS") 28 is identified geologically as being situated at 6,700 ft. Furthermore, the mud line 30 is located at approximately at 3,500 ft where the first string or conductor string 32 is positioned. In the prior art placement of the conductor string 32, the string is placed at the mud line at a jetted depth without regard to the optimal placement. Typically the riserless casing seat placements of the conductor string 32 is based upon the anticipation of shallow drilling hazards 24 with a belief that a casing seat 32 and subsequent casing seat 34 are placed above the drilling hazard 24 to aid in the ability to drill through the hazard 24. This low depth placement provides undesirable leak-off pressures. In this regard, the first casing string 32 which is typically is "jetted" to an arbitrary penetration depth of about 250 to 350 feet below the sea floor. Such placement is not optimal to the well design since the casing settings 32 and 34 do not supply sufficient axial loading resistance for structural support of such good casing strings nor does it provide bending load for the riser bending moment. Deeper casing strings 36 and 38 are placed at calculated depths taking into account drilling hazards, and the placement of the deeper strings is not optimal due to the less than optimal placement of strings 32 and 34.

Referring particularly to FIG. 3, there is shown graphical representation of the employed method for the optimum placement of the riserless casing strings in deepwater drilling environments. The present invention improves upon the prior art placement of casing strings by taking advantage of the early and progressive growth of this subsurface fracture gradient immediately below the mud line. The present invention provides safe "leak-off" for the drilling of subsequent holes in casing installation, mitigates shallow hazards, avoids "wasting" casing diameters in riserless hole sections and optimizes the sizes and number of strings of casing for the entire well. For example, as shown in FIG. 3, a fracture gradient curve 40 is shown along with the pore pressure supra salt curve 42. The depth and geological conditions are identical in the proposed well of FIG. 3 as it is the proposed well of FIG. 2. For example, top of salt 44 is located at 6,700 feet. FIG. 3 demonstrates the optimal setting of the casing seats as the function of the fracture gradient. For example, the fracture gradient at the mud line 46 and is plotted in the y axis 48 until it meets with the pore pressure curve 42. The plot line 48 that meets the pore pressure curve 42 at a point which designates the optimal placement of string casing one 50. Likewise, in determining the second casing seats, the fracture gradient is extrapolated at line 52 along the x-axis to the fracture gradient curve 40 to the leak-off point 54. The leak-off point 54 is then plotted along the y-axis 56 until it meets with the pore pressure curve 42 at point where the second string 58 is placed. Again, by extrapolating along the x-axis by line 60 to the point on the fracture gradient curve 40 a leak-off point 62 is determined. Using this methodology, each of the optimal points for placement of the casing strings is identified.

The system and method of the present invention provides for the use of common oil field tubular diameters to obtain true well vertical depth. This allows for more conventional hole diameters for mechanical and geological side tracks that may be encountered in a lower casing intervals. The well diameter is generally larger than the current art providing for optimal field development flow rates, for the obtainment of well objectives and for the field development economics. Geological "side tracks" involves the drilling operation of creating additional hole intervals between two planned intervals. In typical drilling operations, the objective is to drill in a hole section of a diameter so that the next planned interval can be maintained at the planned diameters. Sidetracks can occur due to mechanical difficulties in the well such as a stuck pipe or can occur to intersect secondary geological targets not possible without the side track operation. The optimal placement of the casing strings also creates a larger annulus than is achieved in the prior art design. Furthermore, the optimal positioning of the placement in the riserless casing can additionally mitigate the anticipated shallow drilling hazard.

Figure 1:
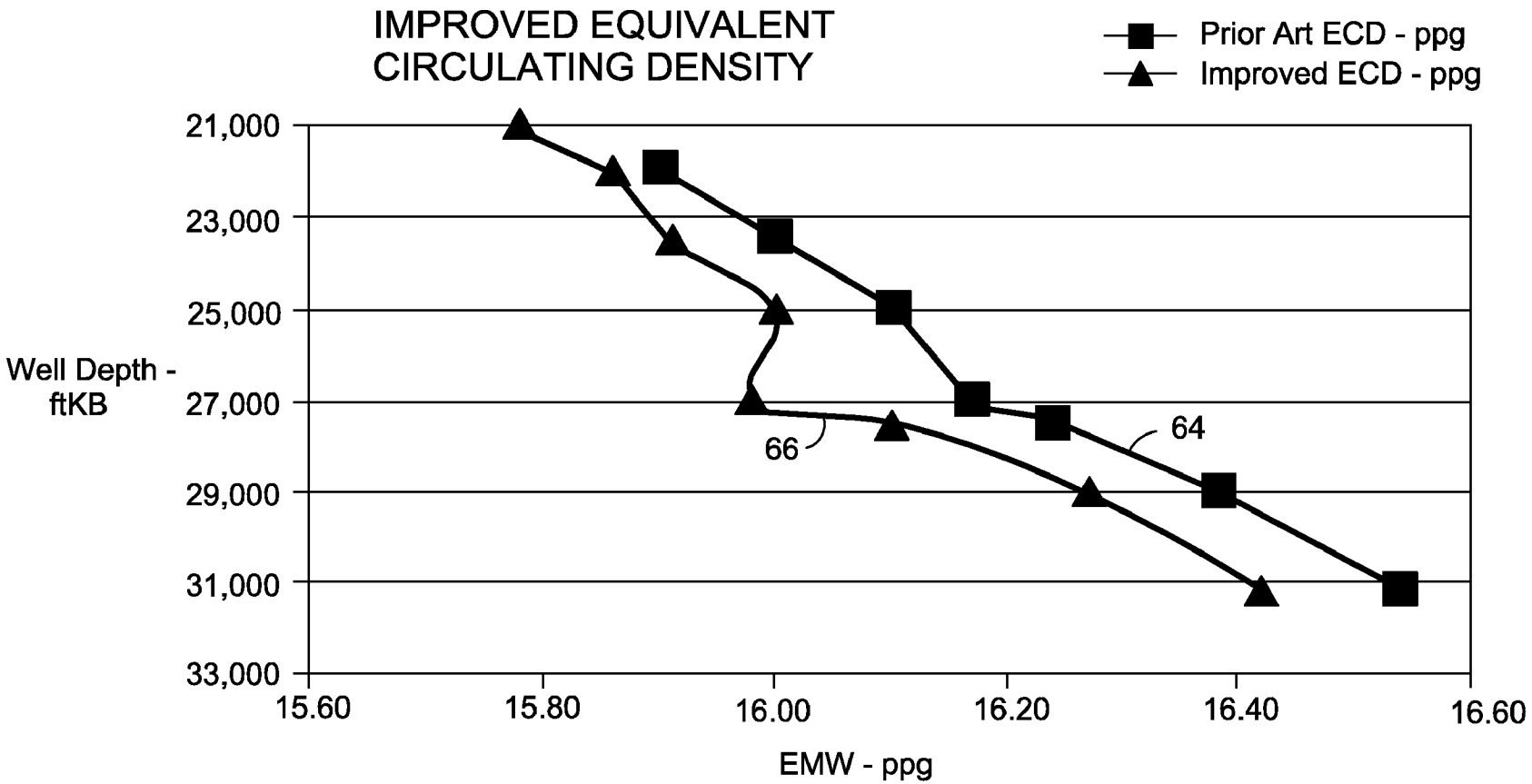
FIG. 1 graphically illustrates the comparison of typical conventional riserless casing well design against the well design of the present invention showing the reduction of equivalent circulating density when there is a reduction of one casing string in the well design.

Referring particularly to FIG. 1, there is shown a comparison of the equivalent circulating density ("ECD") plotted for both the prior art well design with that of the ECD plot of the present invention where the string casing is placed at optimal depth. The prior art ECD is plotted at curve 64 and the improved ECD of the design of a well produced in accordance with the method of the present invention, is shown at curve 66.

As is shown the ECD in the design of the present invention can improve as much as 0.1 pounds per gallon (ppg) near the end of the well, with only a reduction of one casing string from the prior art. Additional ECD reductions would be attained if even fewer casing strings were used. However this is a function of the specific pore pressure and fracture gradient environment for each specific deepwater well location. Even this small difference can mean the ability to being able to drill without losses and with less risk taking a formation influx into the well bore.

Referring particularly to FIGS. 4, there is shown a comparison of FIGS. 2 and 3. FIG. 4 is a graphical representation showing the comparison between the prior art well design of FIG. 2 and the present invention design of FIG. 3.

Figure 4A:
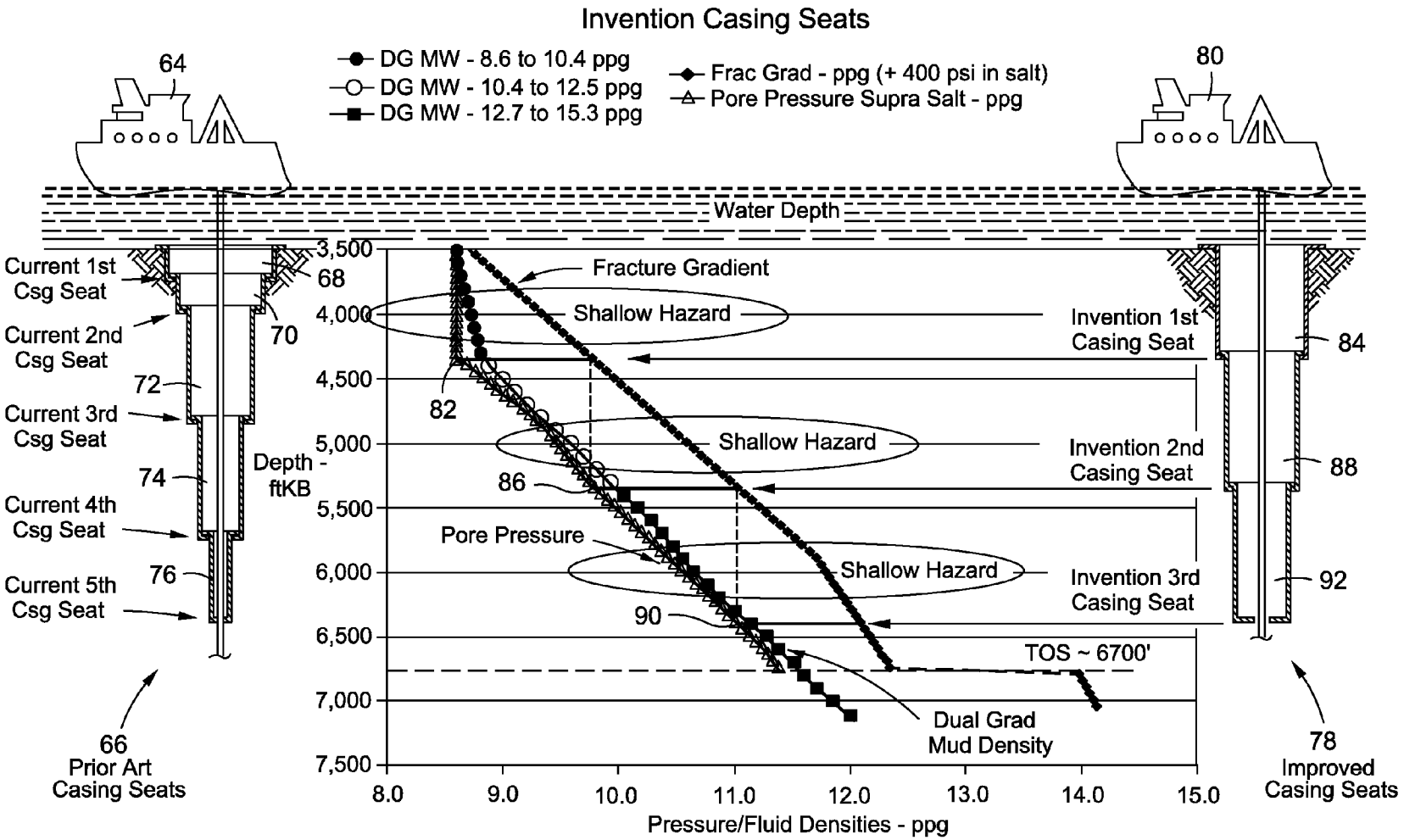
FIG. 4A graphically illustrates the fracture gradient and pore pressure of both the prior art conventional string placement and the placement of the present invention, based upon a different example, with pictorial representations of the casing seats.

FIG. 4A depicts the use of the method of the present invention for optimal placement of casing seats in comparison with another example of the prior art method in relation to a 64 a floating drilling platform. The drilling platform 64 is used in combination with casing seats 66 that have been deployed in accordance with the prior art method. As noted in the example, a water depth of 3,500 feet is provided and a first casing seat 68 is placed at a shallow depth. Again, the placement casing seats 64 is not driven by the optimal placement but rather at a first step in moving forward with the placement of second and subsequent casing seats. For example, a second casing seat is provided 70 which is placed in reverse telescoping fashion within the casing seat 68. Again, casing seats 72, 74 and 76 are each placed in the well at increasing depths without regard to optimal placement. Generally, the placement may be driven by placing casing seats at points just above a drilling hazard based on the belief that such placement facilitates the ability to drill through the drilling hazard. As shown in the example of FIG. 4A, from drilling platform 64 five casing seats were utilized to reach a depth of 6,500 feet. The fifth casing seat 76 has a narrow diameter, which with the diameter reducing telescopic effect on subsequent casing diameters, will limit well fluid production ability to less than optimum, and, as well may limit the ultimate depth at which the well may reach.

On the other hand, the improved casing seat design 78 is shown in association with drilling platform 80. Utilizing the methodology previously described with respect to FIG. 3 the casing seat depth 82 is determined for casing seat 84. Likewise, depth is determined 86 for casing seat 88. Finally the casing seat depth 90 is determined for the third casing seat 92.

As is apparent from the comparison of the prior art casing seat 66 with the improved casing seat 78, the improved casing seat 78 achieves a depth of approximately 6,500 feet while employing only three casing strings as appose to five casing strings for casing seat 66. In this regard, casing diameter is conserved rather than "wasted" as compared with the prior art casing seat 66.

A method of the present invention provides the design steps to enable the well to be drilled deeper and the setting depths for the riserless string of casings to where the formations have a higher degree of competency for fracture resistance and therefore higher leak-off pressure. This allows for the first string of the casing not only to provide the structural integrity necessary to support axial loading of the string of casing but also takes advantage of the growth of the fracture gradient below the mud line thereby affecting leak-off tolerance to continue drilling with the subsequent drilling and inclination of the second string of casing.

Figure 5:
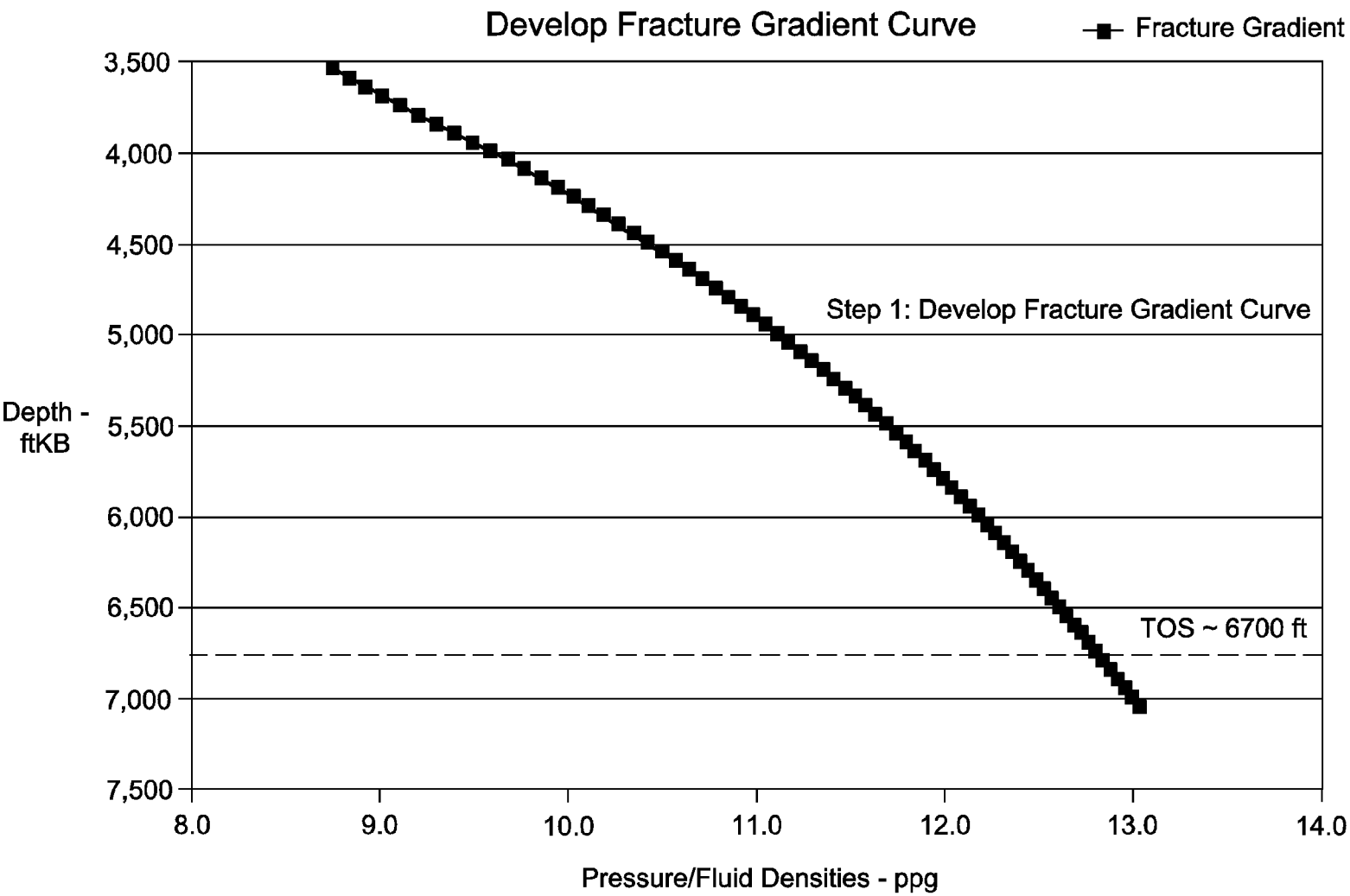
FIG. 5 graphically illustrates the step in the method of the present invention for developing the fracture gradient curve.

Referring particularly to FIGS. 5-8 and FIGS. 9A-9D the method of the present invention is described. In particular, FIGS. 9A through 9D comprise a composite flow-chart of the steps of the present invention. By competing the steps of the method of the present inventions, the method of placing subsea well casings is improved over the approach of the prior art as the method aids in identifying the optimal placement of the casing seats. Although the invention applies to riserless drill sections of deepwater drilling environments, primarily above salt formations (i.e. supra salt) it should be recognized that the present invention can apply to any deepwater riserless environment requiring improvements in casing seat placements, whether salt is present or not present. The method of the present invention operates based upon the premise that casing seat placements must all meet, not only the pore pressure and fracture and gradient leak-off requirements, specifically providing an acceptable leak-off for all subsequent casing string drilling operations, but also must meet structural requirements beginning with the first casing strings. In order to successfully design such a composite or telescopic string of casing and thereby minimizing the number of casing strings to obtain an improved well design, the invention contemplates that the first casing string must provide for and take advantage of the natural progressive growth of the fracture gradient as depicted in FIG. 5. Therefore, the design of the first conductor string provides both structural integrity as well as the leak-off integrity of the drilling in subsequent placement of the next casing. Thus the optimal placement of the first casing string is a critical design difference than the prior art placement of the casing strings of simply jetting in the first casing string at a convenient or arbitrary depth.

The optimized placement of the riserless casing seat in the shallow subsea formations mitigate shallow drilling hazards with the casing true vertical depths being based upon the shallow rapidly growing fracture strength, and reinforced by the smearing effect of casing drilling and improved ECD control of casing drilling. The drilling hazard mitigating aspect of casing drilling of the present invention may also result in achieving still deeper casing seats in those posed in FIGS. 3 and 4A.

Figure 9A:
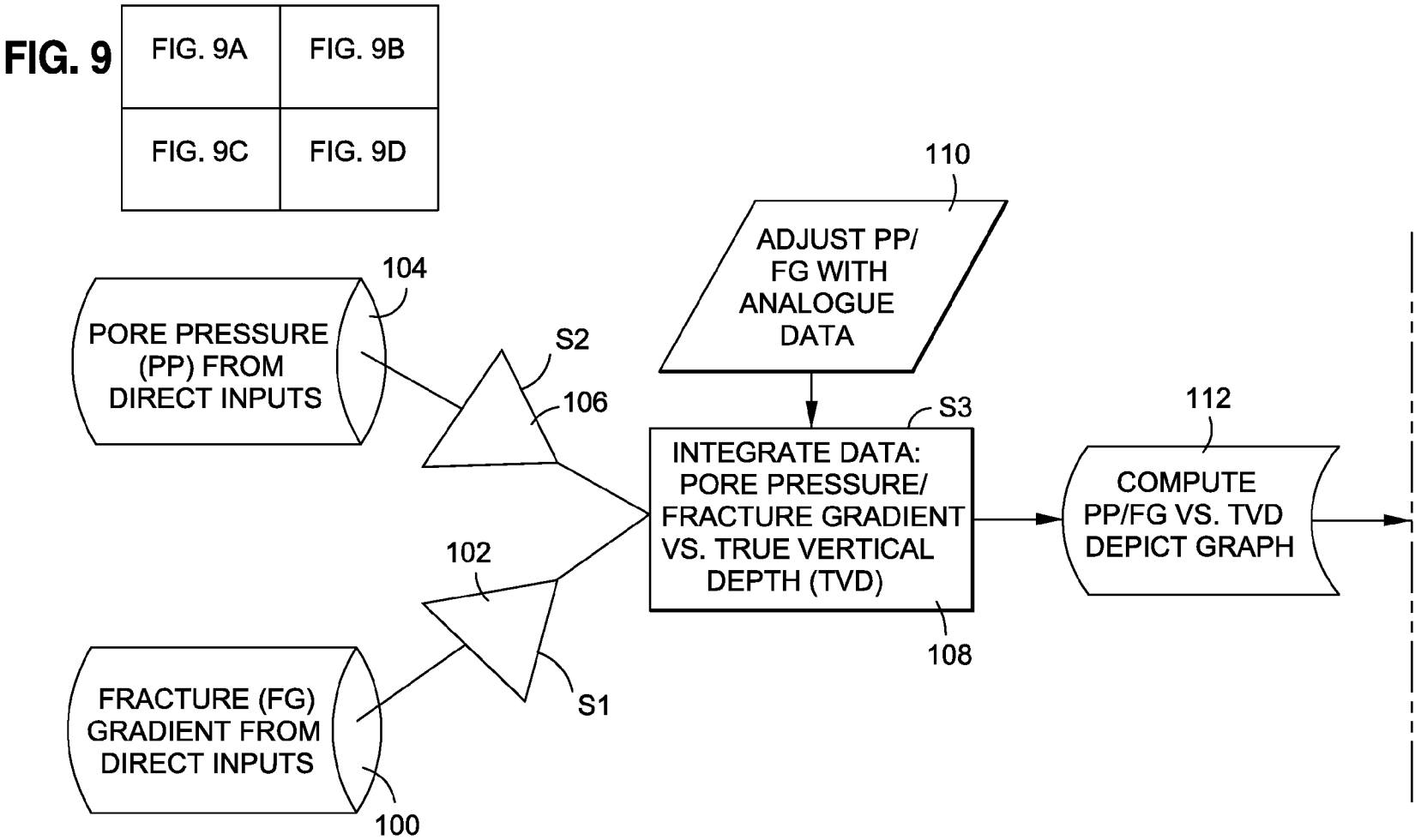
FIG. 9A is a flowchart of a portion of the steps of the method of the present invention.

Referring to FIG. 9A, there is shown the first three steps in the process and method of the present invention. In Step 1 (51) the fracture gradient is obtained from direct inputs 100. Furthermore, pore pressure is additionally obtained from direct inputs 104. The data inputs 100 and 104 may be input manually through a peripheral device into a computer and the data may be stored in memory. It is additionally contemplated by the present invention that such inputs 104 and 100 may be undersea sensors or other input devices. In Step 1, 102, the fracture gradient curve is developed. In the first step of developing fracture gradient, the data from 100 is used in determining the estimated fracture gradient for a proposed deepwater well from below the mud line to the total anticipated true vertical depth of the well. The development of the fracture gradient curve is exemplified in FIG. 5.

In Step 2 of the method of the present invention pore pressure is analyzed and a pore pressure curve is developed 106 from data in element 104. In developing the pore pressure curve the estimated pore pressure for a proposed deepwater well from below the mud line to the total anticipated true vertical depth of the well is exemplified in FIG. 6 (shown with the gradient curve from FIG. 5).

Figure 6:
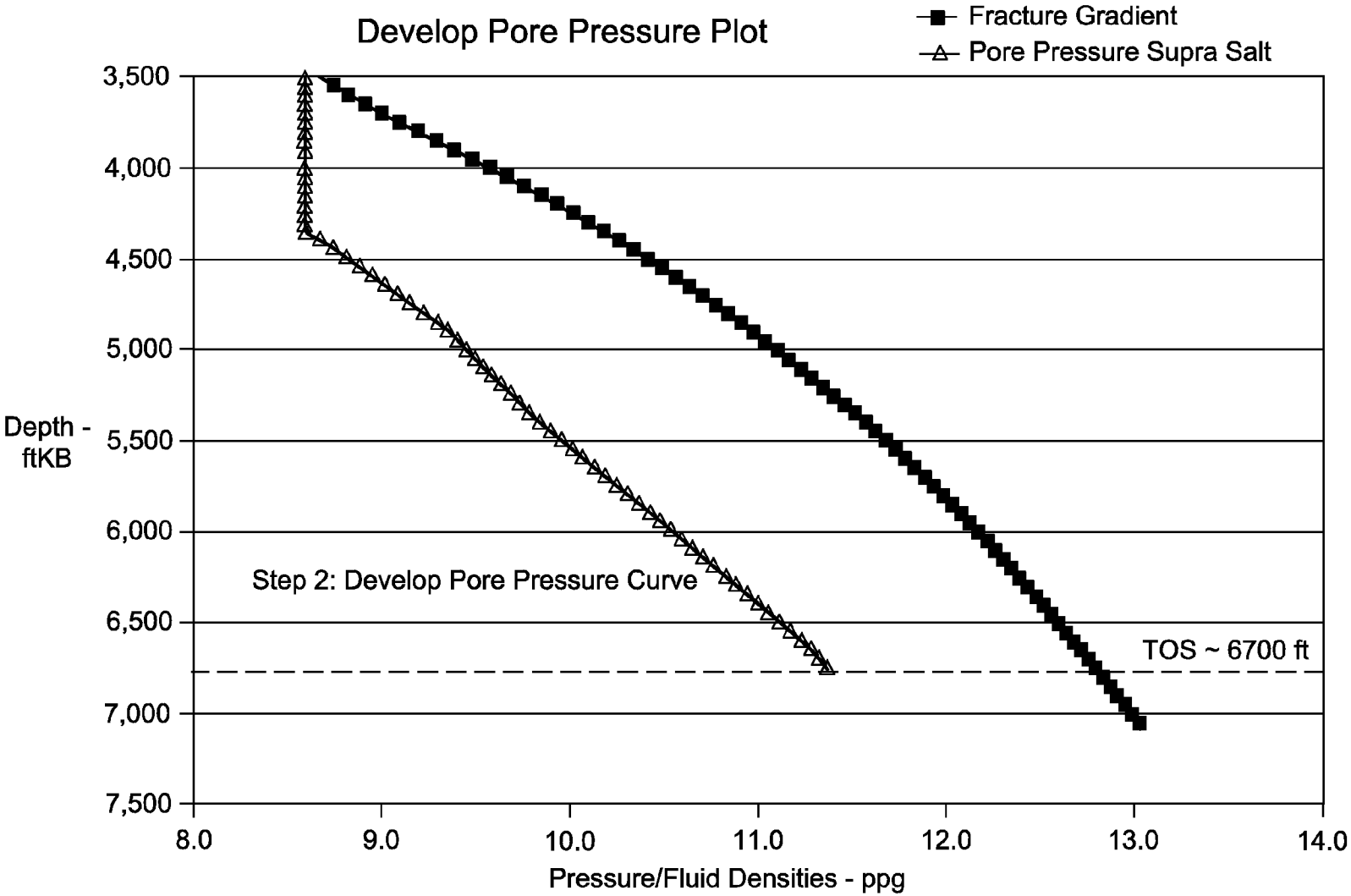
FIG. 6 graphically illustrates the step in the method of the present invention for developing the pore pressure plot.
Figure 7:
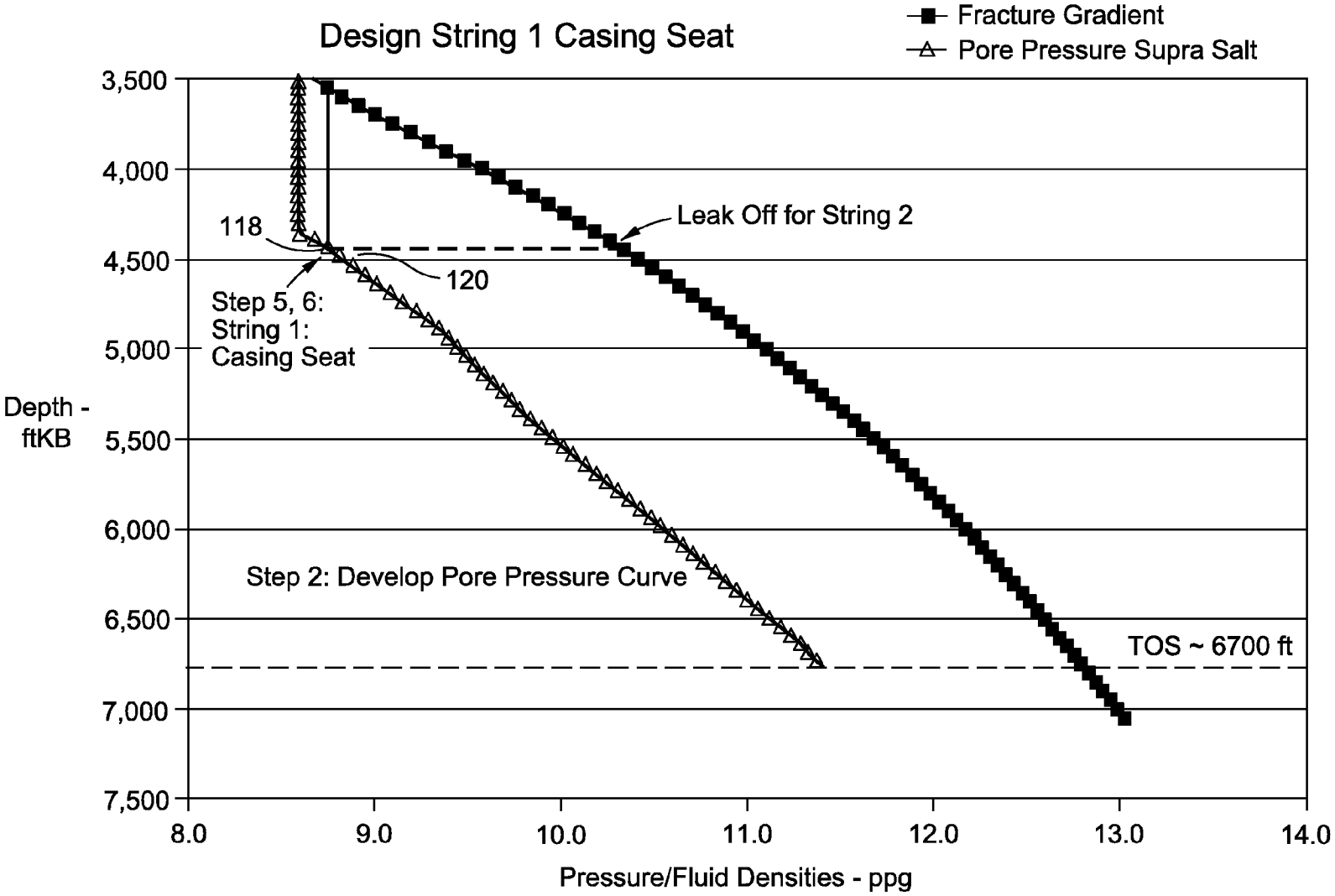
FIG. 7 graphically illustrates the step in the method of the present invention for identifying the optimal placement of the initial casing string.

In the third step, the data is integrated to develop a pore pressure/fracture gradient versus total vertical depth graphic. The graphic which includes both the fracture gradient curve and the pore pressure curve is shown in FIG. 6. Using the data developed in the first and second steps, the data is integrated in the third step 108 to develop the total anticipated true vertical depth of the well, and extend the pore pressure/fracture gradient versus true vertical depth curve to interpolate and depict optimum setting true vertical depths for all casing strings. In 110, the graph may be adjusted to the input of the observable data which may have not been obtained through the data inputs of 100 and 104. In 112, the data developed inputs 104 and 100 as well as the observable data from 110 a graph is computed in 112.

Figure 9B:
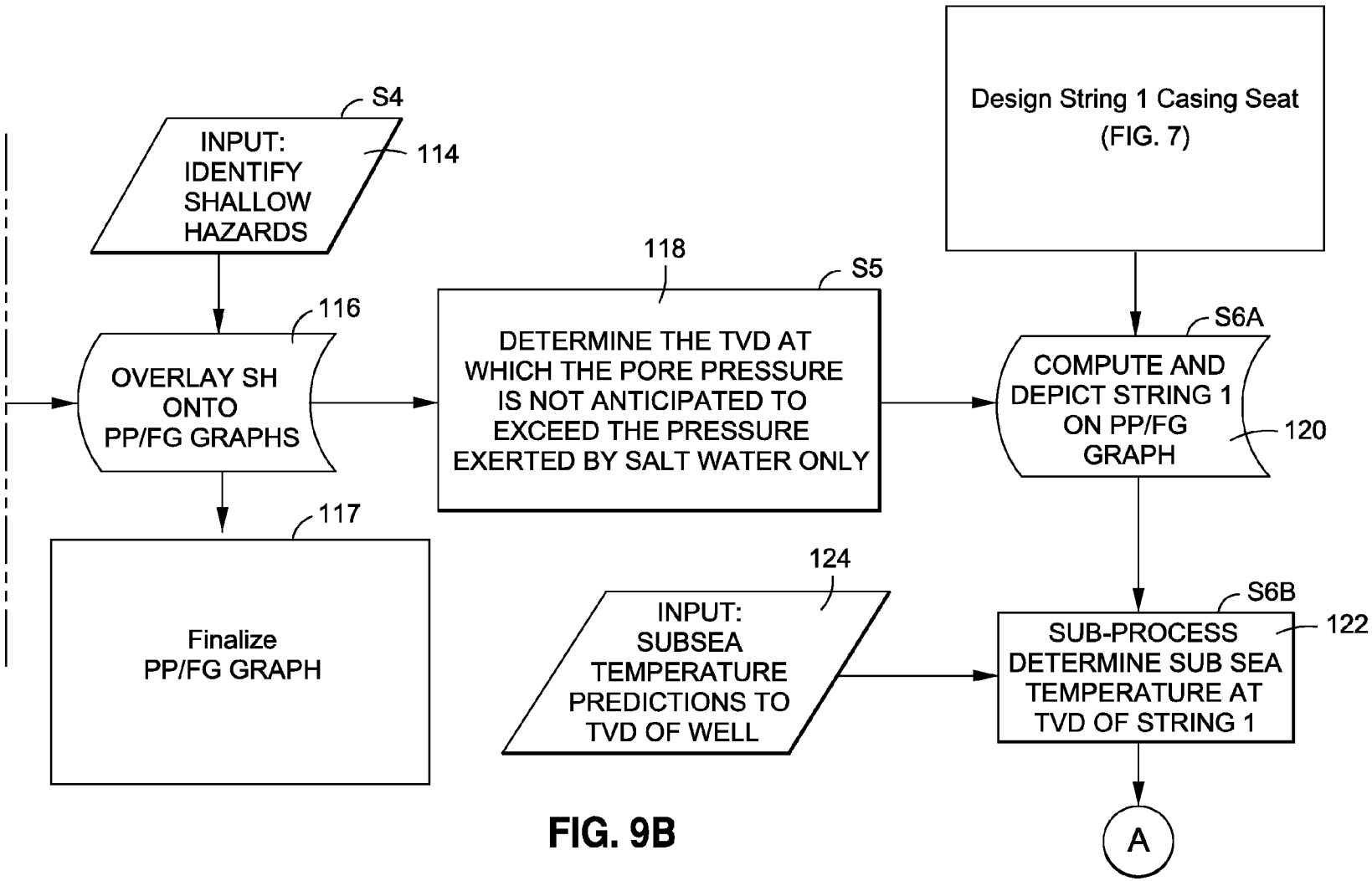
FIG. 9B is a flowchart of a portion of the steps of the method of the present invention.

Referring particularly to FIG. 9B, Step 4, 114 is shown as inputting the identification of shallow hazards. Then the input data may be stored in a computer memory. Step 4, 114 identifies the possible presence and location of shallow drilling hazards. The method may thereafter assess the magnitude and risk of the shallow hazard data. The shallow hazard data is overlaid onto the pore pressure/fracture gradient plot 116 and a Pore Pressure plot is developed and finalized in 117. In Step 5 118 from the graph information a determination is made of the deepest true vertical depth at which the pore pressure is not anticipated to exceed the pressure exerted by the salt water only. A more detailed discussion with respect to FIG. 3 indicates the calculation and extrapolation that is involved in determining this position. In Step 6A the location and placement of the conductor casing is placed on the graph 120. Step 6A determines the optimum setting true vertical depth of riserless string one by interpolating a subsea true vertical water depth where the pore pressure begins to exceed the normal gradient of salt water. The corresponding feature gradient true vertical depth becomes the setting true vertical depth for casing string one. The salt water gradient is the amount of pressure, expressed in pounds per square inch (or similar units such as metrics) per true vertical foot of water depth (psi/foot) exerted by a column of salt water.

The requirements for string one therefore ensures that the true vertical depth is deep enough to facilitate an acceptable "leak-off" for the drilling of string two, but, must also meet the engineered design requirements for landing support of string two. It is noteworthy that the hole section drilled for the first casing string placement is within a pressure environment governed only by the salt water gradient of the pressure envelope. Since this true vertical depth environment is represented only by the salt water gradient and the formations are soft, transmissible and unconsolidated sediments incapable of trapping oil and gas deposits, then there is no potential geological trap for higher pressure free hydrocarbon hazards in the depositional environments. The added stress of overburdens gradient does not affect this pore pressure environment at this true vertical depth. Overburden is the amount of pressure or stress expressed in pounds per square inch (or similar units such as metrics) for true vertical foot of well depth below the ocean flow mud line (psi/foot) and imposed on a layer of soil or rock by the weight of the over lining material.

Hazards such as frozen methane, mud loses, and fresh water flows, are the only three possible shallow hazards that may be encountered since there is not a geological trap. Mitigating shallow hazards is a requirement for all drilling operations. Riserless dynamic kill density mud is commonly used for shallow drilling operation and the ability to employ mud density as achieved by dual gradient mud system equal to or slightly greater than the weight of salt water. Dynamic kill weight or dynamic kill density is the equivalent circulating density composite dual gradient mud density necessary to effect a mud balance to ensure the integrity to counteract any pore stress related pressure of the hole section being drilled. A dual mud gradient system represents the dual gradient mud weight of the riserless drilling system. The first component is the gradient of sea water from the rig floor to the sea bed or mud line, and the second component represents the column weight of the mud gradient in the wellbore being drilled. The combination of these two gradients represents the composite mud density of the circulating dual gradient mud system.

Methane Hydrate is a gas in frozen state and occurs in sediments in water depths greater than 300 m, and in temperatures less than 2 degree C. Its occurrence in the frozen state is governed by Boyle's Law and therefore predictable where these conditions occur. If the gas is in a frozen state it will not migrate unless in-situ temperatures and/or pressures are changed and therefore the gas remains static and therefore not a moveable dynamic drilling hazard. Care must be taken to avoid heating or disassociating or melting the gas, however, absent disassociation, this has no bearing on casing seat optimization for the first string of casing. The byproducts of disassociation are free natural gas and water either of which can become artificially induced drilling hazards.

The primary hazard then becomes fluid losses if the equivalent circulating density of mud weight exceeds the formation pressure. Fresh water flows are mitigated using dynamic kill weight mud. Casing drilling has a known improving ability to mitigate fluid loss and is a method of choice from mitigation on this shallow hazard.

There is only one other factor that can influence the ability to optimize the first casing string true vertical depth and that is the presence of a known shallow trap. In this case the optimum true vertical depth would be governed by the true vertical depth of the geological base of the trap. Depending on the deepwater basin this may have the net affect of shortening the first casing strings true vertical depth, but nonetheless achieve the objective of optimizing the first casing seat beyond the conventional jetting true vertical depth for first casing string.

In steps 6B, element 122 the method of the present invention develops a temperature gradient to true value depth. Input is received from 124 which include the subsea temperature prediction to the true value depth of the well. In 122 this step determines if the temperature envelope (Boyle' s Law) allows for a frozen gas environment (Methane Hydrate).

Figure 8:
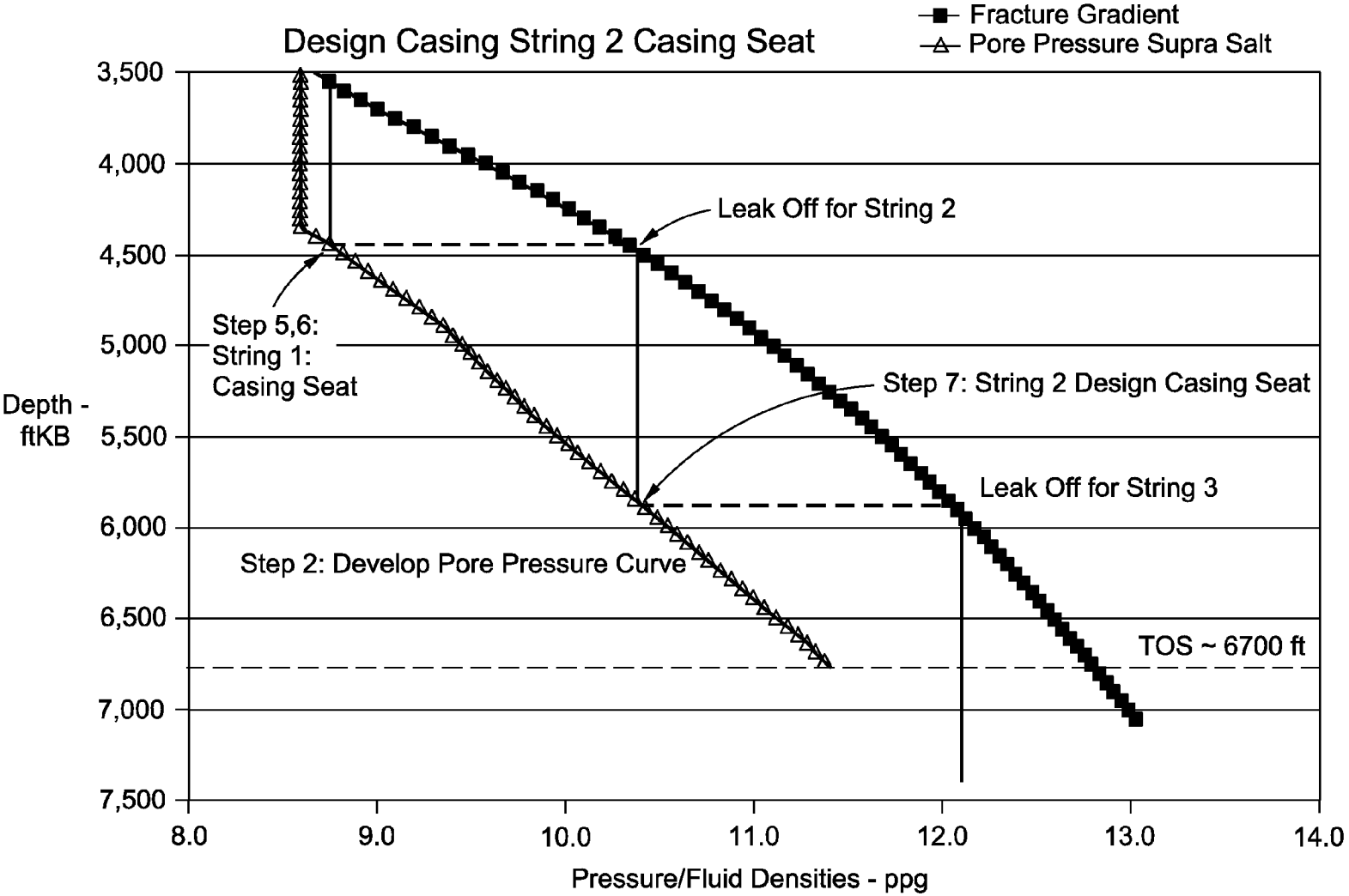
FIG. 8 graphically illustrates the step in the method of the present invention for identifying the optimal placement of subsequent deeper casing strings.
Figure 9C:
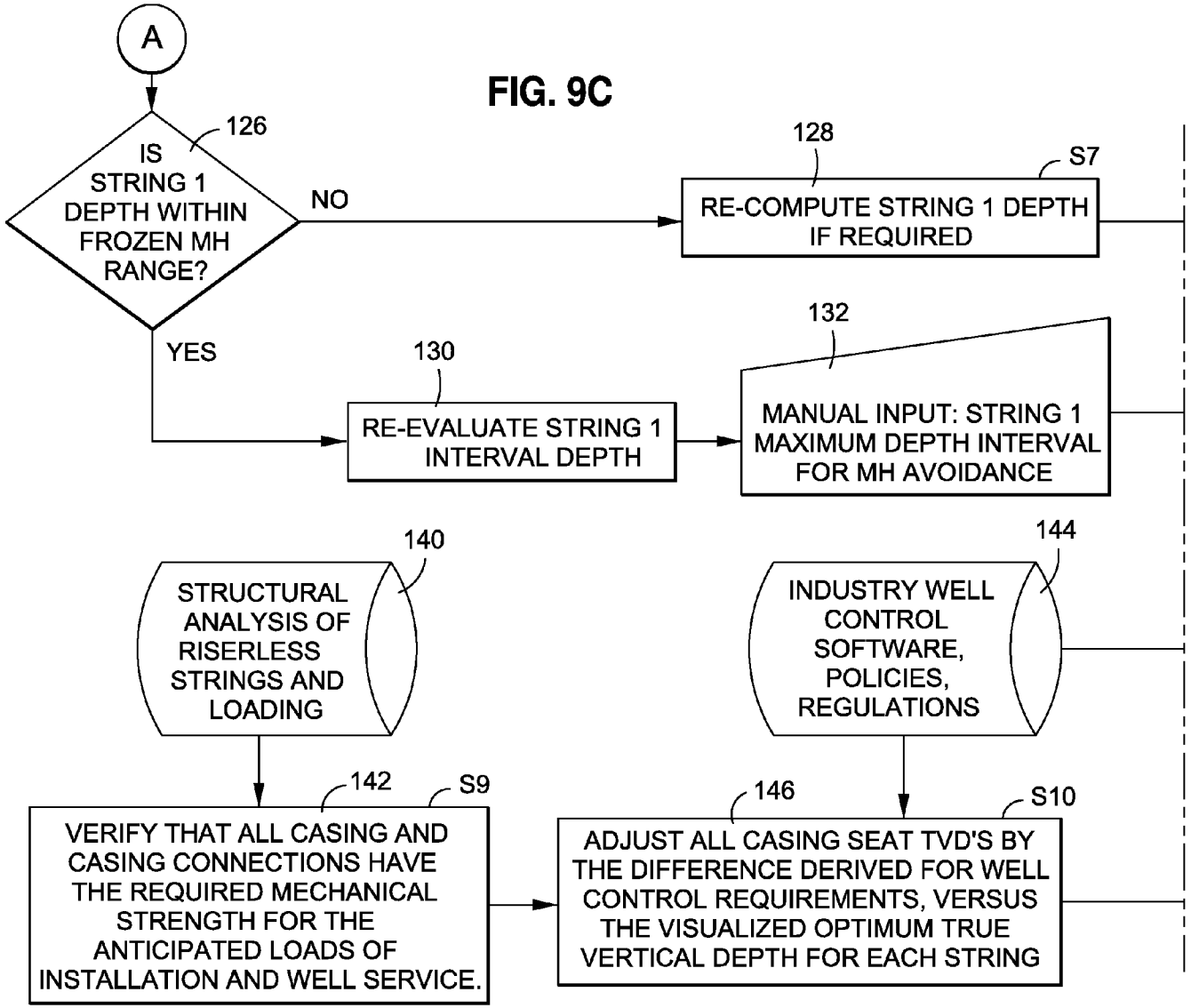
FIG. 9C is a flowchart of a portion of the steps of the method of the present invention.
Figure 9D:
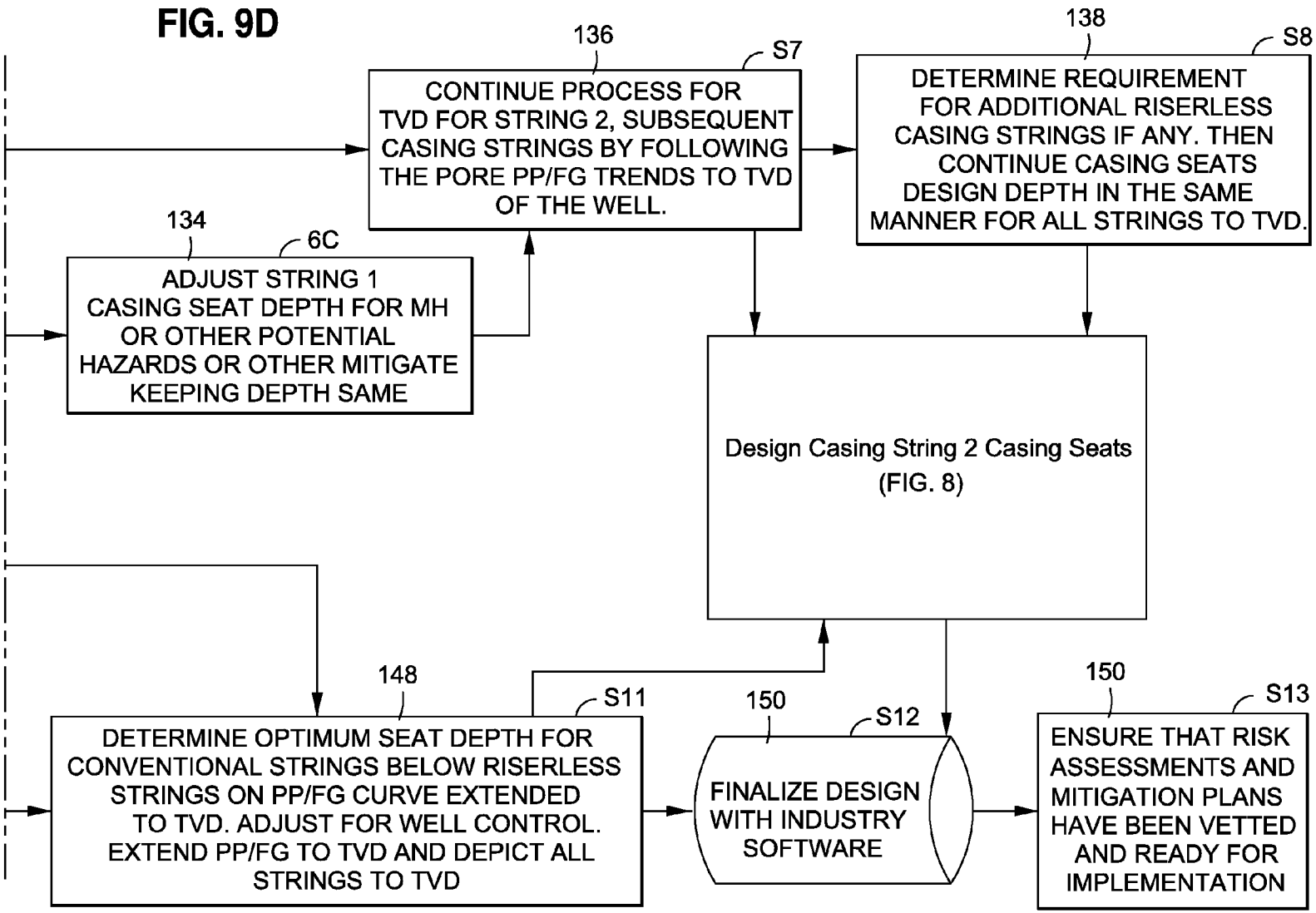
FIG. 9D is a flowchart of a portion of the steps of the method of the present invention.

Referring to FIGS. 9C and 9D, in element 126 a determination is made as to whether the first casing string placement is within the frozen Methane Hydrate range. If the answer is "no" the process includes element 128 that can re-compute the string one depth, if necessary. If the string one is within the frozen range 126 ("yes") then the process diverts to element 130 where the interval depth of string one is re-evaluated. At that point, manual input may be solicited at 132 for the placement of the maximum depth interval for Methane Hydrate avoidance. In 134 Step 6C string one may be adjusted for casing seat depth for Methane Hydrate or other potential hazards or other mitigation keeping the depth the same. The purpose of element 134 is to change the depth of the first casing string to accommodate a setting depth above the Methane Hydrate or other mitigant. Methane Hydrate occurs at depth and deep water environment according to temperature. If it is possible that the Methane Hydrate will occur, either the casing seat depth must be change to accommodate the depth by setting the casing to avoid the potential hazard, or some other mitigant applied such as controlling circulating temperature if possible to mitigate accordingly. Once the temperature has been taken into account in steps 6A, 6B and 6C the process is continued for Step 7 in element 136 to determine the true value depth for string two and subsequent casing string by following the pore pressure/fracture gradient trends to the true value depth of the well. Therefore in process element 138 additional requirements are determined for additional riserless casing strings, if any, then continue casing seats designed depth in the same manner for all strings to true value depth. The process is continued to determine the optimal true vertical depth for the second casing string by following the pore pressure/fracture gradient trends to total true vertical depth of the well. Following this trend the process visualizes the optimum true vertical depth for second casing string as well as sub strings required to reach the true vertical depth. The process for the selection of the additional riserless casing strings in step 8 is shown in FIG. 8.

Referring to FIG. 8, it is important that the hole section for the second casing string have the ability to mitigate further shallow hazards such as trapped oil or gas. Overburden begins to become consolidated, less transmissible, and more capable of forming traps for free hydrocarbons. The ability of the mud density and equivalent circulating density must be able to offset in-situ pore pressure as well as the increasing stress of the overburdened. Losses can be mitigated with casing drilling, as discussed above, and the smaller annular volume improves the reaction time and decreases the possibility of channeling (smaller annulus), for increasing dynamic kill (ECD) weight required to offset these in-situ conditions. In Step 8 138, the method evaluates the requirement for any additional riserless casing strings to be drilled prior to running the casing that will continue drilling the well in the conventional manner. Determine the optimum casing seat true vertical depth in the same manner as steps 5-7. Additional alternate steps may be provided within the method of the present invention. For example, a structural analysis of riserless strings and loading 140 can be implemented in Step 9. This requires a verification that all casing and casing connections have the required mechanical strength for the anticipated loads of installation and well service. Furthermore, industry well control software and regulations may require additional steps as discussed in Steps 10 and 11. For example Step 10 includes the adjusting of all casing true seats depths by the difference derived for kick tolerance (well control) requirements, versus the visualized optimum true value depth for each string. This represents the safest true vertical depth at each hole section can be drilled to and warrants that leak-off tolerance will not be exceeded. The kick tolerance is the maximum kick volume of fluid that can be taken into the wellbore and circulated out without fracturing the formation at a weak point (shoe) thereby exceeding the leak-off, given a difference between the pore pressure and the equivalent circulating density, mud density in use.

Casing seats design true vertical depths, may also be adjusted for a pore pressure safely factor. That is, the user may have a policy or procedure in place to adjust the pore pressure estimates to a higher value to help ensure that the applied equivalent mud weight and circulating density does not exceed a safe tolerance that might risk wellbore stability for flow or well control events in the interval being drilled.

Likewise, Step 11 may be implemented to develop the optimum seat depth for all conventional strings below the riserless casing strings using the same pore pressure fracture gradient curves extended to total depths. The step applies the appropriate well tolerances and adjusts the casing seats design depths accordingly. Further Step 11, element 150 may include the finalizing of the riserless casing design by conducting a complete engineering and structural analysis to ensure that all weights grades, and sizes of casing strings meet or exceeds the operator requirements for safe and successful completion of the well for further conventional drilling and casing installation. A final step 13, element 150 may include drilling hazard mitigation by ensuring drilling risk assessments and mitigation plans have been vetted and are ready for implementation.

What is claimed is:

1. In a computer-based system, a method for optimal placement of a support casing in a subsea drilling environment, the method comprising:

receiving input of pore pressure data for a well site;

receiving input of fracture gradient for said well site;

receiving input of the anticipated true vertical depth of said well site;

integrating pore pressure data, fracture gradient data with said true vertical depth values;

computing a pore pressure and fracture gradient verses true vertical depth graph;

determining the true vertical depth at which the pore pressure begins to exceed the normal gradient of salt water; and determining the optimum placement of a conductor casing string by corresponding the gradient true vertical depth to the true vertical depth of where the pore pressure begins to exceed the normal gradient of salt water.

2. The method of claim 1 wherein said step of integrating pore pressure data, fracture gradient data with true vertical depth also includes the integration of additional observable data.

3. The method of claim 1 further comprising the step of identifying the potential location of shallow drilling hazards.

4. The method of claim 3 further comprising the step of assessing the risk associated with identified potential drilling hazards.

5. The method of claim 3 further comprising the step of integrating the shallow hazard data into the integrating of data step.

6. The method of claim 1 further comprising the step of receiving temperature data at the true vertical depth of the determined conductor casing string.

7. The method of claim 6 further comprising the step of adjusting the depth of the conductor casing string in response to temperature data.

8. The method of claim 1 further comprising the steps of:

determining the true vertical depth at which the pore pressure begins to exceed the normal gradient of salt water for the second casing string; and determining the placement of a second casing string by corresponding the gradient true vertical depth to the true vertical dept of where the pore pressure beings to exceed the normal gradient of salt water.

9. The method of claim 1 further comprising the step of applying well control tolerances and adjusting the casing seat design depths.

10. An apparatus for processing well depth and casing placement data comprising:

a. at least one memory for storing: (i) data input of pore pressure data for a well site; (ii) data input of fracture gradient for said well site; (iii) data input of anticipated true vertical depth of said well site; and b. a processor for (i) receiving the data from said memory; (ii) integrating pore pressure data, fracture gradient data with said true vertical depth values; (iii) computing a pore pressure and fracture gradient verses true vertical depth graph; (iv) determining the true vertical depth at which the pore pressure begins to exceed the normal gradient of salt water; and (v) determining the placement of a conductor casing string by corresponding the gradient true vertical depth to the true vertical depth of where the pore pressure beings to exceed the normal gradient of salt water.

11. The apparatus of claim 10 wherein said memory stores additional input observable data.

12. The apparatus of claim 11 wherein said processor receives said observable data and integrates said data in said true vertical depth graph.

13. The apparatus of claim 10 wherein said memory stores the identified potential location of shallow drilling hazards.

14. The apparatus of claim 13 wherein processor receives drilling hazard data and computes the risk associated with identified potential drilling hazards.

15. The apparatus of claim 10 wherein said memory stores input temperature data at the true vertical depth of the determined conductor casing string.

16. The apparatus of claim 15 wherein said processor receives said input temperature data computes an adjusted depth of the conductor casing string.

17. The apparatus of claim 10 wherein said process also (i) determining the true vertical depth at which the pore pressure begins to exceed the normal gradient of salt water for the second casing string; and (ii) calculates the placement of a second casing string by corresponding the gradient true vertical depth to the true vertical dept of where the pore pressure beings to exceed the normal gradient of salt water.

18. The apparatus of claim 10 wherein said memory stores well control tolerances.

19. The apparatus of claim 18 wherein said processor receives the well control tolerances data from said memoir and computes adjustments of the casing seat design depths.

20. An article of manufacture comprising a program storage medium readable by a computer, the medium tangibly embodying one or more programs of instructions executable by a computer to perform a method for optimal placement of a support casing in a subsea drilling environment comprising:

accessing data input of pore pressure data for a well site;

accessing data input of fracture gradient for said well site;

accessing data input of anticipated true vertical depth of said well site; and integrating pore pressure data, fracture gradient data with said true vertical depth values;

computing a pore pressure and fracture gradient verses true vertical depth graph; determining the true vertical depth at which the pore pressure begins to exceed the normal gradient of salt water; and determining the placement of a conductor casing string by corresponding the gradient true vertical depth to the true vertical dept of where the pore pressure beings to exceed the normal gradient of salt water.

21. The method of claim 20 wherein said integrating pore pressure data, fracture gradient data with true vertical depth also includes the integration of additional observable data.

22. The method of claim 20 further comprising identifying the potential location of shallow drilling hazards.

23. The method of claim 22 further comprising assessing the risk associated with identified potential drilling hazards.

24. The method of claim 22 further comprising integrating the shallow hazard data into the integrating of data.

25. The method of claim 20 further comprising the step of receiving temperature data at the true vertical depth of the determined conductor casing string.

26. The method of claim 25 further comprising adjusting the depth of the conductor casing string in response to temperature data.

27. The method of claim 20 further comprising determining the true vertical depth at which the pore pressure begins to exceed the normal gradient of salt water for the second casing string; and determining the placement of a second casing string by corresponding the gradient true vertical depth to the true vertical dept of where the pore pressure beings to exceed the normal gradient of salt water.

28. The method of claim 20 further comprising applying well control tolerances and adjusting the casing seat design depth.

29. A method for optimal placement of a support casing in a subsea drilling environment comprising:

producing computer executable program code; and providing the program code to be deployed to and executed on a computer system, the program code comprising instructions for:

receiving input of pore pressure data for a well site;

receiving input of fracture gradient for said well site;

receiving input of the anticipated true vertical depth of said well site;

integrating pore pressure data, fracture gradient data with said true vertical depth values;

computing a pore pressure and fracture gradient verses true vertical depth graph;

determining the true vertical depth at which the pore pressure begins to exceed the normal gradient of salt water; and determining the placement of a conductor casing string by corresponding the gradient true vertical depth to the true vertical depth of where the pore pressure beings to exceed the normal gradient of salt water.

30. The method of claim 29 wherein said step of integrating pore pressure data, fracture gradient data with true vertical depth also includes the integration of additional observable data.

31. The method of claim 29 further comprising the step of identifying the potential location of shallow drilling hazards.

32. The method of claim 31 further comprising the step of assessing the risk associated with identified potential drilling hazards.

33. The method of claim 31 further comprising the step of integrating the shallow hazard data into the integrating of data step.

34. The method of claim 29 further comprising the step of receiving temperature data at the true vertical depth of the determined conductor casing string.

35. The method of claim 34 further comprising the step of adjusting the depth of the conductor casing string in response to temperature data.

36. The method of claim 29 further comprising the steps of:

determining the true vertical depth at which the pore pressure begins to exceed the normal gradient of salt water for the second casing string; and determining the placement of a second casing string by corresponding the gradient true vertical depth to the true vertical depth of where the pore pressure beings to exceed the normal gradient of salt water.

37. The method of claim 29 further comprising he step of applying well control tolerances and adjusting the casing seat design depths.

* * * * *